United States Patent [19]

Meier

[11] Patent Number: 5,065,745

[45] Date of Patent: Nov. 19, 1991

[54] PORTABLE RESPIRATORY PROTECTION DEVICE

[75] Inventor: Peter Meier, Lindau, Switzerland

[73] Assignee: Micronel AG, Switzerland

[21] Appl. No.: 584,593

[22] Filed: Sep. 19, 1990

[30] Foreign Application Priority Data

Sep. 29, 1989 [CH] Switzerland ..... 3541/89

[51] Int. Cl.[5] ..... A62B 7/10; A62B 23/02

[52] U.S. Cl. ..... 128/205.12; 128/206.12; 128/204.18; 128/201.25; 128/205.27

[58] Field of Search ..... 128/201.22–201.25, 128/201.28, 206.12, 204.18, 205.27, 205.25, 205.12

[56] References Cited

U.S. PATENT DOCUMENTS

| | | | |
|---|---|---|---|
| 1,929,343 | 10/1933 | Belloni | 128/201.25 |
| 3,565,068 | 2/1971 | Bickford | 128/201.25 |
| 3,822,698 | 7/1974 | Guy | 128/201.25 |
| 3,963,021 | 6/1976 | Bancroft | 128/201.25 |
| 4,127,122 | 11/1978 | Kienhofer et al. | 128/201.25 |
| 4,233,972 | 11/1980 | Hauff et al. | 128/205.25 |
| 4,430,995 | 2/1984 | Hilton | 128/205.12 |
| 4,522,639 | 6/1985 | Ansite et al. | 128/201.25 |
| 4,590,951 | 5/1986 | O'Connor | 178/201.25 |

FOREIGN PATENT DOCUMENTS

| | | | |
|---|---|---|---|
| 560877 | 5/1944 | United Kingdom | 128/201.25 |
| 2413959 | 7/1975 | United Kingdom | 128/201.25 |
| 2032284 | 8/1980 | United Kingdom | 128/201.25 |

*Primary Examiner*—Edgar S. Burr
*Assistant Examiner*—Lisa E. Malvaso
*Attorney, Agent, or Firm*—Webb, Burden, Ziesenheim & Webb

[57] ABSTRACT

A respiratory protection device having a housing with a housing arm on which a filter having an inlet and an outlet is detachably mounted. The housing has a suction opening for ambient air that is generally covered by a portion of the filter. Spaces are formed between the filter and the housing through which ambient air can pass to the suction opening. A radial blower is located in the housing in communication with the suction opening to convey ambient air under pressure through a channel located in the housing arm to the filter. The covering of the suction opening by the filter prevents water drip or spray from passing into the interior of the housing and prevents accidental covering of the opening.

16 Claims, 2 Drawing Sheets

PORTABLE RESPIRATORY PROTECTION DEVICE

BACKGROUND OF THE INVENTION

This invention relates generally to portable respiratory protection devices and more particularly to positive-pressure respiratory protection devices which include at least one detachable filter mounted on a housing and a blower located in the housing to draw ambient air into the housing through a suction opening which is supplied under pressure to the filter.

Devices of this type are required by persons who require respiratory assistance in order to overcome inhalation resistance. Such devices are also part of the equipment utilized by pilots and persons who must work in contaminated environments. The power supply for the blower is usually a battery pack which is located within the housing. The blower draws ambient air into the housing through a suction opening and forces the air under pressure through the filter. These devices are generally called positive-pressure respiratory protection devices and are more reliable than devices in which the air is drawn through the filter by a low pressure. In addition, the devices of the invention are simply constructed so that the air volume can be controlled, i.e., the amount of air which is delivered to the filter by the blower can be adjusted to the requirements of the user.

Presently known devices of this type are unwieldy and bulky and require a water drip or spray into the housing which can damage the blower, the blower controls and the battery pack.

The invention provides a portable respiratory protection device, in which the suction opening in the housing shell is effectively protected against water drip or spray and which is compact and easily manageable. The device is relatively inexpensive to manufacture and is simple to operate and maintain.

In a device according to the invention the suction opening in the housing shell is closely adjacent to a portion of the exterior of the filter and ambient air is drawn from spaces between the housing and the filter through the suction opening when the blower is operating. The suction opening is essentially covered by the adjacent portion of the filter and is thereby protected against the entrance of water drip or spray and other liquids and solid materials in the ambient air. Because a portion of the filter serves as the cover for the suction opening, no additional protection such as louvers or a screen is required.

According to the invention, the housing includes at least one arm which supports a filter. An air channel formed in the arm leads from the blower located in the housing body to a connecting opening located in the housing arm which is in communication with the filter inlet. This arrangement results in a compact construction and a short air channel between the blower and the filter.

The features which characterize the invention are pointed out with particularity in the claims annexed to and forming a part of this disclosure. For a better understanding of the invention, its operating advantages and the specific objects attained by its use, reference should be had to the accompanying drawings and descriptive matter in which preferred embodiments of the invention are illustrated and described. Like reference characters describe like parts throughout the drawings.

DESCRIPTION OF THE PREFERRED EMBODIMENTS

Figure 1:
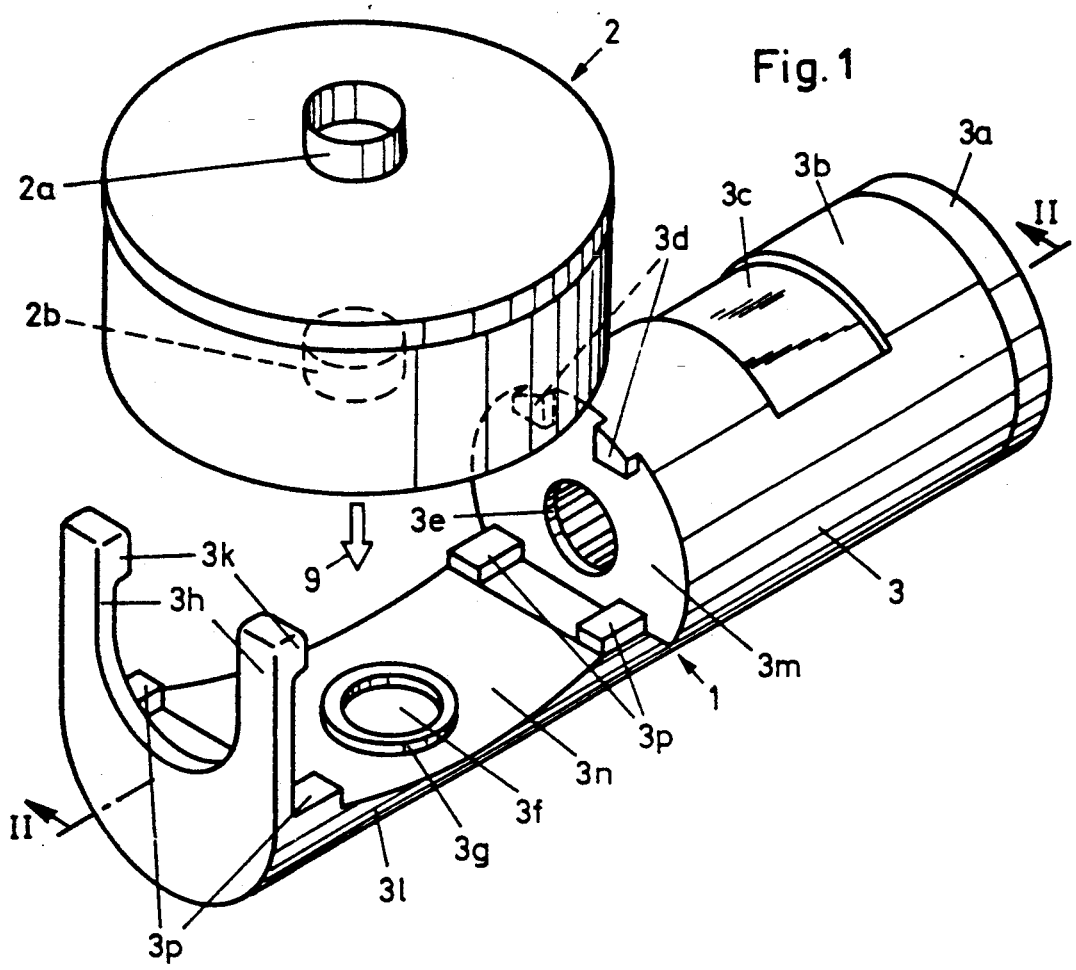
FIG. 1 is a perspective of a respiratory protection device according to one embodiment of the invention with the filter removed from the housing arm.

As shown in FIG. 1 of the drawings, a commercial air filter 2 having an inlet **2*b* on the bottom and an outlet 2*a* on the top is detachably mounted on an arm 31 of a housing 3 of the respiratory protection device 1. The filter is placed on the housing arm in the direction of the arrow 9 and is connected by a breathing hose (not shown) to a face mask or helmet which is worn by the user. When the filter is in place on housing arm 31, guide dogs 3*d* on housing shell 3*m* and guide dogs 3*k* on spaced resilient end clamp legs 3*h* hold the filter in place with inlet 2*b* in communication with connection opening 3*f* and the bottom surface of the filter resting on a flat sealing ring 3*g*. The position of filter 2 relative to the upper surface of housing arm 31 is determined by the seats 3*p*. The housing 3 includes a body 3*b* having a removeable end cover 3*a* and housing shell 3*m***. The housing is preferably produced of a plastic material by injection molding.

Figure 2:
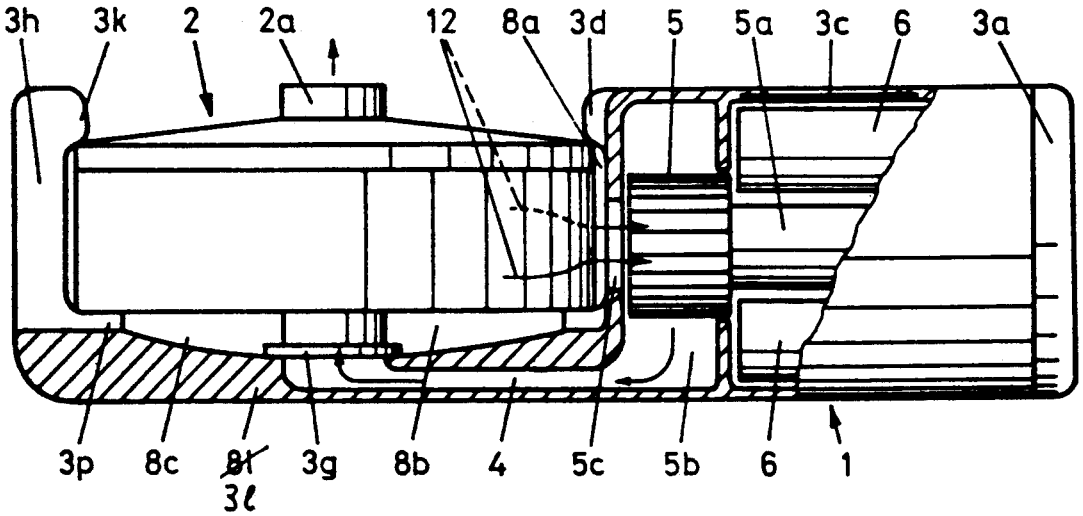
FIG. 2 is a section on line II—II in FIG. 1 with the filter located in the housing arm.

As also shown in FIG. 2 of the drawings, radial blower 5, which is well-known to those skilled in the art, is located adjacent the shell **3*m* of housing 3 and is driven by a coaxial electric motor 5*a*. A battery pack 6 is located in the body 3*b* of housing 3 to provide power for electric motor 5*a*. Monitoring of battery pack 6 is possible through a transparent window 3*c* in body 3*b* and the battery pack can be replaced or recharged by removing cover 3*a*. The motor 5*a*** is turned on and off by a manual switch (not shown) for operating the blower.

The inlet opening **5*c* for blower 5 is located immediately behind a suction opening 3*e* that is located generally in the center of shell 3*m* of the housing. As shown in FIG. 2 of the drawings, filter 2 generally covers suction opening 3*e* but spaces 8*a*, 8*b* and 8*c* are open so that ambient air can flow through suction opening 3*e* and inlet opening 5*c* to the blower. Ambient air passes through space 8*a* to the suction opening from both sides of the filter as indicated by the arrows 12. The upper surface 3*n* of housing arm 31 is downwardly curved so that spaces 8*b* and 8*c* are formed between the bottom surface of filter 2 and surface 3*n*. Therefore, ambient air can flow into the spaces and pass along the upper surface of arm 31 to suction opening 3*e*. Due to accessibility from all sides, the spaces 8*a*, 8*b* and 8*c* can be relatively small while still permitting sufficient ambient air to flow to suction opening 3*e* to inlet opening 5*c* of blower 5 when the blower is operating. The air flows from blower 5 under increased pressure through a channel 5*b* into a channel 4 in housing arm 31. Air under pressure passes from channel 4 through inlet opening 2*b* into the interior of filter 2, where contaminants are effectively removed. An average of about 40–60 liters of air per minute can be cleaned by filter 2. The clean air flows out of the filter through outlet 2*a***.

As shown in FIG. 2 of the drawings, filter 2 housing arm 31 and may be easily gripped by a user wearing gloves so as to be removed for replacement. When the filter is removed from housing arm 31, clamp legs 3*h* are elastically deflected. A filter 2 may be replaced on housing arm 31 in the direction of the arrow 9 so that spaced guide dogs 3*d* and 3*k* rest on the edge of the top surface of the filter to hold the filter in place on the housing arm.

Figure 3:
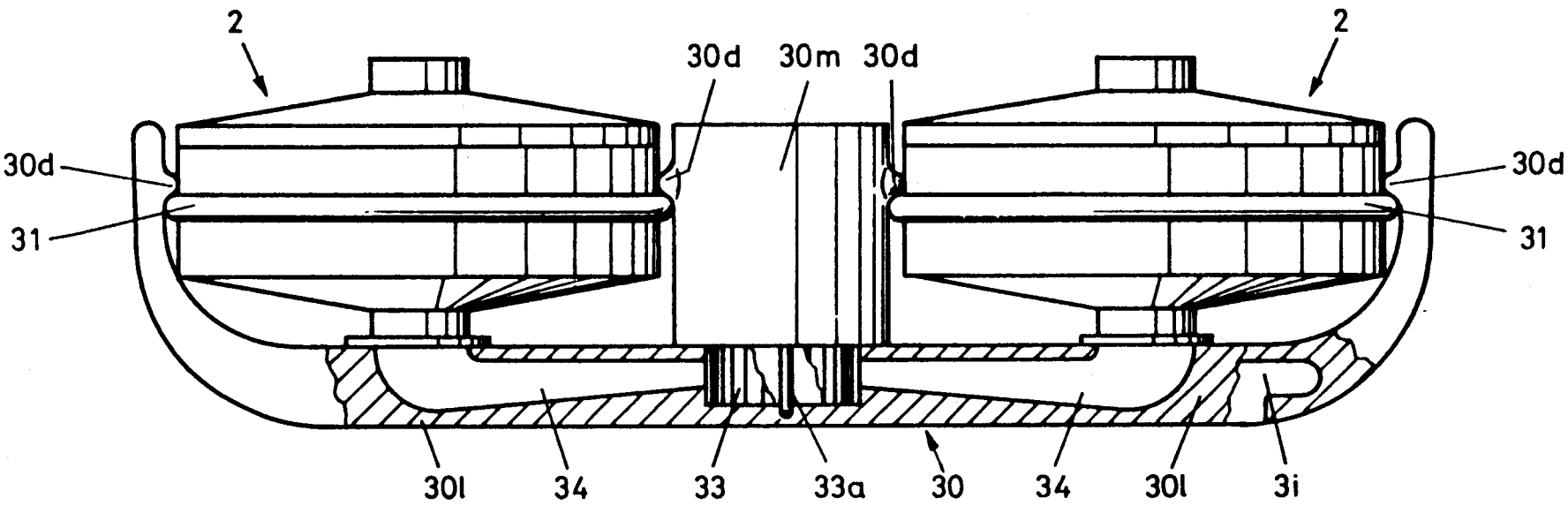
FIG. 3 is a partial section of a respiratory protection device according to a second embodiment of the invention.

The embodiment of the respiratory protection device shown in FIG. 3 of the drawings has a housing 30 with two housing arms 301 extending in opposite directions from a blower housing 30*m*. A known radial blower 33 having a rotation axis 33*a* is located in housing 30*m* and conveys pressurized air into a channel 34 formed in each of the housing arms 301 and the air flows from each channel 34 through a filter 2. The blower 33 has a removeable cover (not shown), through which the battery pack can be replaced or recharged. Each filter 2 has an annular locking ring 31 formed on its outer cylindrical surface which snaps below holding lugs 30*d* on housing 30 when the filter is in position. The lugs 30*d* can also be spring-loaded metal balls or ring segments. A suspension band (not shown) for the device can be located in a recess 3*i* formed in the bottom of housing 30. Even though two filters 2 are used in the embodiment shown in FIG. 3 of the drawings, the device is comparatively small and can be easily carried under a jacket, for example, without a problem.

Notwithstanding the considerable advantages of the respiratory protection devices according to the invention, they are very compact and relatively light in weight and can be produced with a few simple components. A respiratory protection device according to the invention is designed to meet the protection requirements of the user but is also easy to use and is reliable due to its simple and compact construction.

The foregoing describes preferred embodiments of the invention and is given by way of example only. The invention is not limited to any of the specific features described herein, but includes all such variations thereof within the scope of the appended claims.

I claim:

1. A portable positive pressure filtered air respiratory protection device including a housing having a shell, an air canister filter having an inlet and an outlet detachably mounted on said housing, a suction opening formed in said housing shell essentially covered by said canister filter, but including spaces between said canister filter and said housing so that ambient air can flow to said suction opening, a blower located in said housing for drawing ambient air into said housing for passage to said canister filter, channel means formed in said housing for connecting said canister filter with said suction opening, said housing partially enclosing and supporting said canister filter and having a connection opening in communication with said canister filter inlet and said channel means extending between said connection opening and said blower, and means on the exterior of said housing shell for holding said canister filter on said housing.

2. A portable positive pressure filtered air respiratory protection device as set forth in claim 1, wherein said housing includes a housing arm, said housing arm having means for partially enclosing and supporting said canister filter.

3. A portable positive pressure filtered air respiratory protection device as set forth in claim 2, wherein the longitudinal axis of said suction opening is located at approximately right angles to the longitudinal axis of said connection opening and said means on the exterior of said housing shell is for holding said canister filter on said housing arm.

4. A portable positive pressure filtered air respiratory protection device as set forth in claim 2, wherein said housing arm has a free end and means on said free end of said housing arm for holding said canister filter on said housing.

5. A portable positive pressure filtered air respiratory protection device as set forth in claim 3, wherein said housing arm has a free end and means on said free end of said housing arm for holding said canister filter on said housing.

6. A portable positive pressure filtered air respiratory protection device as set forth in claim 4, wherein said means located on said free end of said housing arm are resilient clamp legs having guide dogs arranged to cooperate with said means on said housing shell to center said canister filter relative to said connection opening during insertion of said canister filter on said housing arm.

7. A portable positive pressure filtered air respiratory protection device as set forth in claim 6, including shaped seats on the upper surface of said housing arm to support said canister filter on said housing arm.

8. A portable positive pressure filtered air respiratory protection device as set forth in claim 2, including a seal located at said connection opening and said connection opening being located substantially in the center of said housing arm.

9. A portable positive pressure filtered air respiratory protection device as set forth in claim 3, including a seal located at said connection opening and said connection opening being located substantially ian the center of said housing arm.

10. A portable positive pressure filtered air respiratory protection device as set forth in claim 4, including a seal located at said connection opening and said connection opening being located substantially in the center of said housing arm.

11. A portable positive pressure filtered air respiratory protection device as set forth in claim 5, including a seal located at said connection opening and said connection opening being located substantially in the center of said housing arm.

12. A portable positive pressure filtered air respiratory protection device as set forth in claim 6, including a seal located at said connection opening and said connection opening being located substantially in the center of said housing arm.

13. A portable positive pressure filtered air respiratory protection device as set forth in claim 1, wherein said housing includes two housing arms extending in opposite directions, a canister filter located on each of said housing arms, the axes of each of said canister filters and the axis of rotation of said blower being substantially parallel and channel means in each of said housing arms for connecting said blower with each of said canister filters.

14. A portable positive pressure filtered air respiratory protection device as set forth in claim 13, including holding means on each of said housing arms for one of said canister filters on said arm and means on the exterior of each of said canister filters for cooperating with said holding means to hold said canister filters on said housing arms.

15. A portable positive pressure filtered air respiratory protection device as set forth in claim 1, wherein said housing is unitary.

16. A portable positive pressure filtered air respiratory protection device as set forth in claim 13, wherein said housing is unitary.

* * * * *

UNITED STATES PATENT AND TRADEMARK OFFICE

CERTIFICATE OF CORRECTION

PATENT NO. : 5,065,745

DATED : November 19, 1991

INVENTOR(S) : Peter Meier

It is certified that error appears in the above-identified patent and that said Letters Patent is hereby corrected as shown below:

Column 3 Line 1 after "filter 2" insert --projects laterally outward on both sides of the edges of--.

Claim 9 Line 31 Column 4 "ian" should read --in--.

Signed and Sealed this

Twentieth Day of April, 1993

*Attest:*

MICHAEL K. KIRK

*Attesting Officer*

*Acting Commissioner of Patents and Trademarks*